US011446656B2

(12) United States Patent
Long

(10) Patent No.: US 11,446,656 B2
(45) Date of Patent: Sep. 20, 2022

(54) DRIVING METHOD AND DRIVING SYSTEM FOR DIGITAL MICROFLUIDIC CHIP

(71) Applicants: BEIJING BOE OPTOELECTRONICS TECHNOLOGY CO., LTD., Beijing (CN); Beijing BOE Technology Development Co., Ltd., Beijing (CN)

(72) Inventor: Feng Long, Beijing (CN)

(73) Assignees: BEIJING BOE OPTOELECTRONICS TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 630 days.

(21) Appl. No.: 16/338,811

(22) PCT Filed: Jul. 9, 2018

(86) PCT No.: PCT/CN2018/094943
§ 371 (c)(1),
(2) Date: Apr. 2, 2019

(87) PCT Pub. No.: WO2019/062267
PCT Pub. Date: Apr. 4, 2019

(65) Prior Publication Data

US 2021/0362148 A1 Nov. 25, 2021

(30) Foreign Application Priority Data

Sep. 29, 2017 (CN) ..... 201710910461.6

(51) Int. Cl.
*B01L 3/00* (2006.01)

(52) U.S. Cl.
CPC ... *B01L 3/502715* (2013.01); *B01L 3/502784* (2013.01)

(58) Field of Classification Search
CPC .. B01L 3/502715; B01L 3/5027; B01L 3/502; B01L 3/50; B01L 3/502784;
(Continued)

(56) References Cited

U.S. PATENT DOCUMENTS 8,173,000 B1 5/2012 Hadwen et al.
8,828,336 B2 9/2014 Hadwen et al.
(Continued)

FOREIGN PATENT DOCUMENTS

CN 102175744 A 9/2011
CN 102600919 A 7/2012
(Continued)

OTHER PUBLICATIONS

Hong, Three-dimensional digital microfluidic manipulation of droplets in oil medium, Scientific Reports | 5:10685 | DOI: 10.1038/srep10685., Jun. 2, 2015. (Year: 2015).*
(Continued)

*Primary Examiner* — Christine T Mui
(74) *Attorney, Agent, or Firm* — Dilworth & Barrese, LLP.; Michael J. Musella, Esq.

(57) ABSTRACT

A driving method for a digital microfluidic chip, the digital microfluidic chip including a first electrode and a second electrode that are adjacent, the driving method including: applying a first driving signal to the first electrode and a second driving signal to the second electrode, wherein an applying period of the first driving signal and an applying period of the second driving signal are mutually staggered, and a total time length of the applying period of the first driving signal is less than a total time length of the applying period of the second driving signal.

15 Claims, 7 Drawing Sheets

(58) Field of Classification Search
CPC ..... G01N 27/226; G01N 27/22; G01N 27/02; G01N 27/00
USPC ..... 422/502, 500; 436/43
See application file for complete search history.

(56) References Cited

U.S. PATENT DOCUMENTS

| | | | |
|---|---|---|---|
| 9,239,328 | B2 | 1/2016 | Chang et al. |
| 9,254,485 | B2 | 2/2016 | Chang et al. |
| 2014/0166484 | A1 | 6/2014 | Chang et al. |
| 2016/0296929 | A1 | 10/2016 | Chen et al. |

FOREIGN PATENT DOCUMENTS

| | | | |
|---|---|---|---|
| CN | 102824933 | A | 12/2012 |
| CN | 102879453 | A | 1/2013 |
| CN | 103865789 | A | 6/2014 |
| CN | 107617451 | A | 1/2018 |
| EP | 2484449 | A1 | 1/2012 |
| JP | H10267801 | A | 10/1998 |
| JP | 2012163956 | A | 8/2012 |
| JP | 2012176397 | A | 9/2012 |
| WO | 2017007757 | A | 1/2017 |

OTHER PUBLICATIONS

Extended European Search Report from European Patent Application No. 18861776.5 dated Oct. 22, 2021.
Fau et al, "Asymmetric electrowetting—moving droplets by a square wave", Lab Chip, The Royal Society of Chemistry, Jun. 29, 2007, vol. 7, pp. 1330-1335.
Partial European Search Report from Application No. 18861776.5 dated May 31, 2021.
International Search Report and Written Opinion dated Sep. 21, 2018 from State Intellectual Property Office of the P.R. China.
Japanese Office Action from Japanese Patent Application No. 2019569427 dated Apr. 11, 2022.

* cited by examiner

DRIVING METHOD AND DRIVING SYSTEM FOR DIGITAL MICROFLUIDIC CHIP

TECHNICAL FIELD

The present disclosure relates to a driving method and a driving system for digital microfluidic chip.

BACKGROUND

"Lab-on-chip" refers to concentrating the analysis process of biochemical samples onto small-area chips. It greatly reduces the cost of biochemical analysis, and is highly intelligent and easy to carry. Based on the concept of Lab-on-chip, experiments such as preparation, reaction, separation and detection are launched thereto to better realize control over microscale fluids, the microfluidic chip technology has gradually gained recognition and has promoted rapid development of multidisciplinary such as fluid mechanics and biochemistry.

The microfluidic chip is divided into two types: continuous microfluidic system and digital microfluidic system. The digital microfluidic chip can independently perform a series of operations, like transmitting, mixing, splitting, and detecting, on the micro-nano upgraded droplet containing a sample, thereby effectively avoiding clogging, difficulty in precise control, and complicated manufacturing process in the continuous microfluidic system. The digital microfluidic chip based on microelectrode array can be linked with the superordinate computer through a controller to accurately control movement of the droplet, and it can be repeatedly configured, which is revolutionary in the microfluidic chip.

SUMMARY

The present disclosure provides a driving method for a digital microfluidic chip, the digital microfluidic chip including a first electrode and a second electrode that are adjacent, the method comprising: applying a first driving signal to the first electrode and a second driving signal to the second electrode, controlling an applying period of the first driving signal and an applying period of the second driving signal are mutually staggered, wherein a total time length of the applying period of the first driving signal is less than a total time length of the applying period of the second driving signal.

According to some embodiments of the present disclosure, a frequency of the first driving signal is less than or equal to a frequency of the second driving signal.

According to some embodiments of the present disclosure, a ratio between a total time length of the applying period of the first driving signal and a time length of the driving cycle is in a range of 0.1 to 0.4.

According to some embodiments of the present disclosure, the applying period of the first driving signal includes one continuous first period or a plurality of second periods separated from each other by an interval.

According to some embodiments of the present disclosure, the first period is set in a middle portion of the driving cycle.

According to some embodiments of the present disclosure, a time length of the second period is proportional to a time length of the interval.

According to some embodiments of the present disclosure, the interval of the same time length is between adjacent ones of the second periods.

According to some embodiments of the present disclosure, said method further comprises: at the beginning of the applying period of the first driving signal, detecting a contact angle of the droplet in real time, and setting the frequency of the first driving signal in the applying period as the smaller a detected contact angle is, the lower the frequency is.

According to some embodiments of the present disclosure, said method further comprises: at the beginning of the applying period of the first driving signal, detecting a contact angle of the droplet in real time, and setting a duty ratio of the first driving signal in the applying period as the smaller a detected contact angle is, the smaller the duty ratio is.

According to some embodiments of the present disclosure, said method further comprises: at the beginning of the applying period of the first driving signal, detecting a contact angle of the droplet in real time, and setting a time length of the applying period of the first driving signal as the smaller a detected contact angle is, the longer the time length is.

According to some embodiments of the present disclosure, said method further comprises: at the end of the applying period of the first driving signal, detecting a contact angle of the droplet in real time, and setting a time length of the interval between the applying period of the first driving signal and a next applying period of the first driving signal as the smaller a detected contact angle is, the shorter the time length is.

According to some embodiments of the present disclosure, the first driving signal and/or the second driving signal are set according to thickness of a dielectric layer of the digital microfluidic chip as the thicker the dielectric layer is, the lower the frequency is or the longer the applying period is.

The present disclosure provides a driving system for a digital microfluidic chip, the digital microfluidic chip including a first electrode and a second electrode that are adjacent, the system comprising: a driving signal generating device configured to generate a first driving signal for the first electrode and a second driving signal for the second electrode; and a controller configured to control applying of the first driving signal to the first electrode and the second driving signal to the second electrode, the controller being configured to mutually stagger an applying period of the first driving signal and an applying period of the second driving signal, and the controller being configured to enable a total time length of the applying period of the first driving signal to be less than a total time length of the applying period of the second driving signal.

According to some embodiments of the present disclosure, said system further comprises: a first switching device connected in a loop between the first electrode and the driving signal generating device; and a second switching device connected in a loop between the second electrode and the driving signal generating device, wherein the controller is configured to turn on the first switching device and turn off the second switching device during the applying period of the first driving signal, and configured to turn off the first switching device and turn on the second switching device during the applying period of the second driving signal.

According to some embodiments of the present disclosure, said system further comprises: a contact angle detecting device configured to detect a contact angle of the droplet, wherein the controller is configured to, at the beginning of the applying period of the first driving signal, determine a time length, a duty ratio and/or a frequency of the applying period of the first driving signal according to a contact angle detected by the contact angle detecting device in real time.

According to some embodiments of the present disclosure, said system further comprises: a contact angle detecting device configured to detect a contact angle of the droplet, wherein the controller is configured to, at the end of the applying period of the first driving signal, determine a time length of the interval between the applying period of the first driving signal and a next applying period of the first driving signal according to a contact angle detected by the contact angle detecting device in real time.

According to some embodiments of the present disclosure, said system further comprises: a second timer, configured to time the applying period of the second driving signal; and a third timer, configured to time the applying period of the first driving signal.

DETAILED DESCRIPTION OF THE EMBODIMENTS

Due to a scale decrease of fluid features, flow characteristics of the microfluid are not the same as characteristics of the macroscopic fluid, so the driving control method for the microfluidic is different from that for the macroscopic fluid. In many microfluidic driving and control technologies, surface tension driving has made effective progress, the dielectric wetting technology has become one of the research hotspots of microdroplet driving technology exactly by highly controlling the surface tension.

However, the contact angle hysteresis is ubiquitous in the droplet wetting system in the magnitude order from centimeter to micrometer, as for the microdroplet driving chip, the contact angle hysteresis is one of the important factors hindering the moving speed of the microdroplet, and brings additional errors to microdroplet driving.

In view of this, the embodiments of the present disclosure provide a driving method and a driving system capable of effectively making improvement with respect to the contact angle hysteresis problem in the digital microfluidic chip and capable of improving the moving speed of the droplet.

Respective embodiments of the present disclosure will be described in detail below with reference to the accompanying drawings.

The driving method of the embodiment of the present disclosure is applied to a digital microfluidic chip.

The digital microfluidic chip generally includes a substrate, an electrode array composed of a plurality of rows and columns of electrodes disposed on the substrate, a dielectric layer disposed on the substrate in a manner of covering the electrode array, and a hydrophobic layer overlying the dielectric layer. The droplet is initially released at a position corresponding to one electrode in the electrode array on the hydrophobic layer, and when it needs to move the droplet to a position corresponding to the next electrode on the hydrophobic layer, a driving signal of a certain frequency is continuously applied to the next electrode within a certain driving cycle to pull the droplet to move to this position.

In the existing driving method for the digital microfluidic chip, the contact angle hysteresis is likely to occur during movement of the droplet, improvement can be made with respect to this phenomenon by using the driving method according to the embodiment of the present disclosure.

It should be noted that the timing waveforms in the respective drawings are merely illustrative, not intended to limit the waveforms of the respective driving signals used in actual implementation of the present disclosure.

Figure 1A:
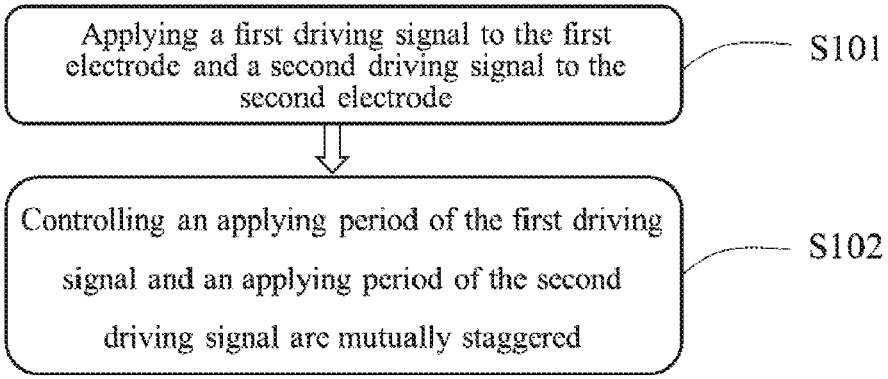
FIG. 1A is a flow diagram showing driving method for a digital microfluidic chip according to embodiments of the present disclosure.

FIG. 1A is a flow diagram showing driving method for a digital microfluidic chip according to embodiments of the present disclosure. As shown in FIG. 1A, at step S101, applying a first driving signal to the first electrode and a second driving signal to the second electrode. And at step S102, controlling an applying period of the first driving signal and an applying period of the second driving signal are mutually staggered. Wherein, a total time length of the applying period of the first driving signal is less than a total time length of the applying period of the second driving signal.

Figure 1B:
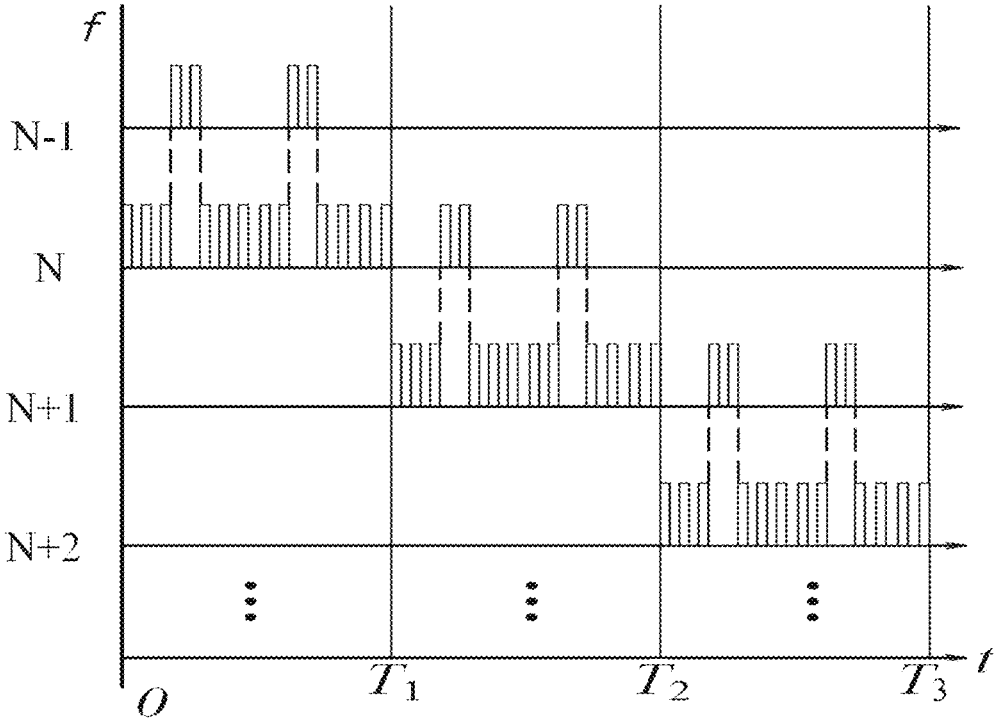
FIG. 1B is a schematic timing diagram of one embodiment of a driving method of the present disclosure.

FIG. 1B is a schematic timing diagram of one embodiment of a driving method of the present disclosure As shown in FIG. 1B, it shows a timing diagram of applying driving signals to electrodes N−1, N, N+1, N+2 that are sequentially adjacent of the digital microfluidic chip. Within a driving cycle T1 of driving the electrode N, that is, the period of moving the droplet on the chip from the position of the electrode N−1 to the position of the electrode N, not only the driving signal is applied to the electrode N but also the driving signal is applied to the electrode N−1 for a certain period, during T1, the electrode N−1 corresponds to the first electrode of the present disclosure, and electrode N corresponds to the second electrode of the present disclosure. Similarly, within a driving cycle T2 of driving the electrode N+1, that is, the period of moving the droplet on the chip from the position of the electrode N to the position of the electrode N+1, not only the driving signal is applied to the electrode N+1 but also the driving signal is applied to the electrode N for a certain period, during T2, the electrode N corresponds to the first electrode of the present disclosure, and electrode N+1 corresponds to the second electrode of the present disclosure. Similarly, within a driving cycle T3 for driving the electrode N+2, that is, the period of moving the droplet on the chip from the position of the electrode N+1 to the position of the electrode N+2, not only the driving signal is applied to the electrode N+2 but also the driving signal is applied to the electrode N+1 for a certain period, during T3, the electrode N+1 corresponds to the first electrode of the present disclosure, and the electrode N+2 corresponds to the second electrode of the present disclosure. The driving manner during the application of the driving signal to the electrode after the electrode N+2 can be derived in a similar way.

In respective embodiments of the present disclosure, the droplet being driven from the first electrode to the second electrode is taken as an example, but the present disclosure is not limited thereto, the first electrode and the second electrode may be interchanged in practical applications, for example, when the droplet moves from the electrode N toward the electrode N+1, the electrode N corresponds to the first electrode, and the electrode N+1 corresponds to the second electrode; when the droplet needs to move from the electrode N+1 to the electrode N in the subsequent step, the electrode N+1 corresponds to the first electrode, the electrode N corresponds to the second electrode.

Referring to FIG. 1B, in the embodiment of the present disclosure, within each driving cycle T1, T2 or T3 or the like, the period of applying the driving signal to the first electrode is staggered from the period of applying the driving signal to the second electrode, that is, at a certain moment within one driving cycle, the driving signal is applied to only one of the first electrode and the second electrode. The driving signal applied to the first electrode corresponds to the first driving signal of the present disclosure, and the driving signal applied to the second electrode corresponds to the second driving signal of the present disclosure. Meanwhile, in the embodiment of the present disclosure, a total time length of the applying period of the first driving signal is smaller than a total time length of the applying period of the second driving signal within each driving cycle T1, T2 or T3 or the like.

By means of the driving method according to the embodiment of the present disclosure, during the driving cycle of the second electrode, that is, during the process of driving the droplet from the first electrode to the second electrode, after the second electrode applies a pulling force to the droplet for a period, the first electrode applies a pulling force to the droplet for a short period, then the second electrode continues to apply the pulling force, so that when the contact angle becomes small as the droplet continues to move in the same direction, the droplet is made to timely move in the opposite direction by a proper distance, after the contact angle is adjusted, then the droplet is made to continue to move in the original direction. Therefore, by the driving solution of the embodiment of the present disclosure, the contact angle during traveling of the droplet in the digital microfluidic chip can be accurately controlled, improvement is made with respect to the existing contact angle hysteresis, and the moving speed of the droplet is increased.

In the embodiment shown in FIG. 1B, the frequency of the first driving signal is substantially the same as the frequency of the second driving signal, but the present disclosure is not limited thereto. In the embodiment of the present disclosure, the frequency of the first driving signal may also be smaller than the frequency of the second driving signal, so as to facilitate shape stability of the droplet.

In the embodiment of the present disclosure, within the driving cycle of the second electrode, the frequency, the amplitude, the duty ratio of the second driving signal of each applying period and the time length of the applying period may be the same or different, the moving speed or the like can be appropriately adjusted as required by the droplet in particular, and the present disclosure is not limited thereto.

Further, in the embodiment shown in FIG. 1B, the applying period of the first driving signal (such as the driving signal applied to N−1 during T1) may include two periods separated from each other by an interval, but the present disclosure is not limited thereto, different embodiments regarding the applying period of the first driving signal will be described in detail below.

Figure 2:
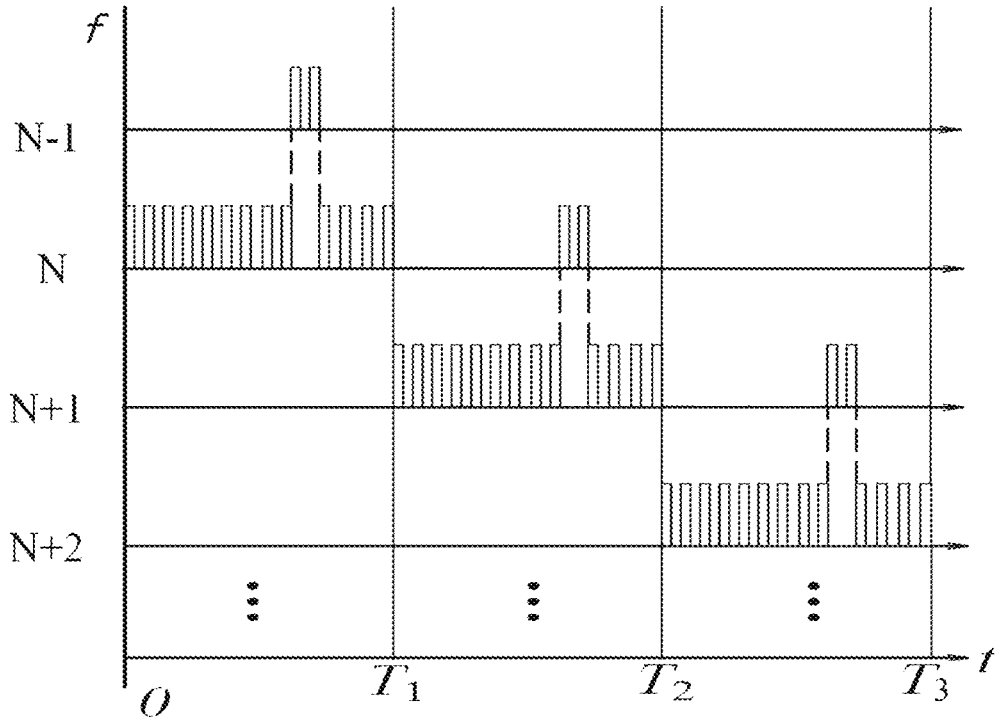
FIG. 2 is a schematic timing diagram of another embodiment of a driving method of the present disclosure.

FIG. 2 is a schematic timing diagram of another embodiment of a driving method of the present disclosure.

As shown in FIG. 2, the applying period of the first driving signal in the present embodiment includes only one continuous period, this one continuous period corresponds to the first period of the present disclosure.

FIG. 2 shows that the first period is set in the middle rear portion of the driving cycle T1/T2/T3, but the present disclosure is not limited thereto. The first period may also be set at the beginning position, the front middle portion, the middle portion, or the rear portion of the driving cycle T1/T2/T3, the position of the first period may be determined specifically according to the contact angle of the droplet detected in real time. For example, during movement of the droplet from the electrode N−1 to the electrode N, it is detected in real time that the contact angle of the droplet is not performed as well as expected, then application of a driving voltage to the electrode N can be stopped, instead a driving voltage may be applied to the electrode N−1 for a while, so as to adjust the contact angle of the droplet at any time, thereby precisely controlling the contact angle of the droplet during movement of the droplet.

In addition to the embodiment in which the first period is set at the same position during T1, T2, T3 as shown in FIG. 2, the present disclosure also includes other various embodiments (not shown), for example, in one embodiment, a first driving signal is applied to the electrode N−1 in the middle portion during T1, the first driving signal is applied to the electrode N in the middle rear portion during T2, the first driving signal is applied to the electrode N+1 in the middle rear portion during T3; in another embodiment, the first driving signal is applied to the electrode N−1 in the front portion during T1, the first driving signal is applied to the electrode N in the middle portion during T2, the first electrode is applied to the electrode N+1 in the middle portion during T3, and so on.

Figure 3:
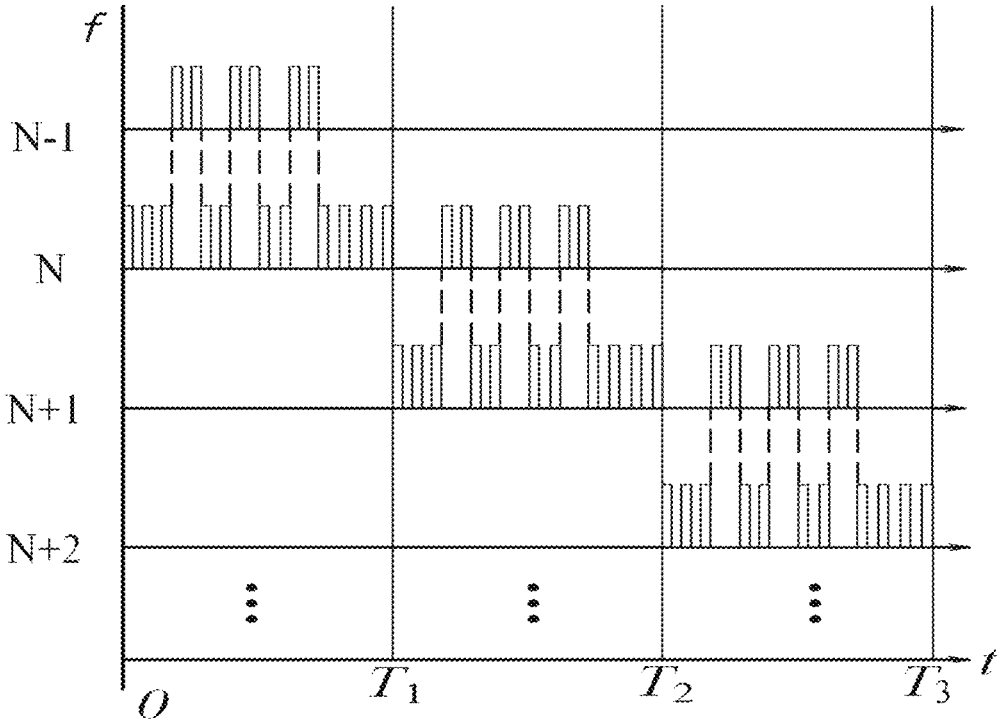
FIG. 3 is a schematic timing diagram of still another embodiment of a driving method of the present disclosure.

FIG. 3 is a schematic timing diagram of still another embodiment of a driving method of the present disclosure;

As shown in FIG. 3, the applying period of the first driving signal within each driving cycle T1/T2/T3 in this embodiment includes three periods separated from each other by an interval, the three periods correspond to the second period of the present disclosure. In this embodiment, the adjacent second periods may have an interval of the same time length. In addition, in this embodiment, the time lengths of the respective second periods may be the same, and the time length of the second period may be proportional to the time length of the interval. The embodiment of the present disclosure is capable of applying a relatively stable force to the droplet through the electrode, which facilitates maintaining a state of the droplet.

Figure 4:
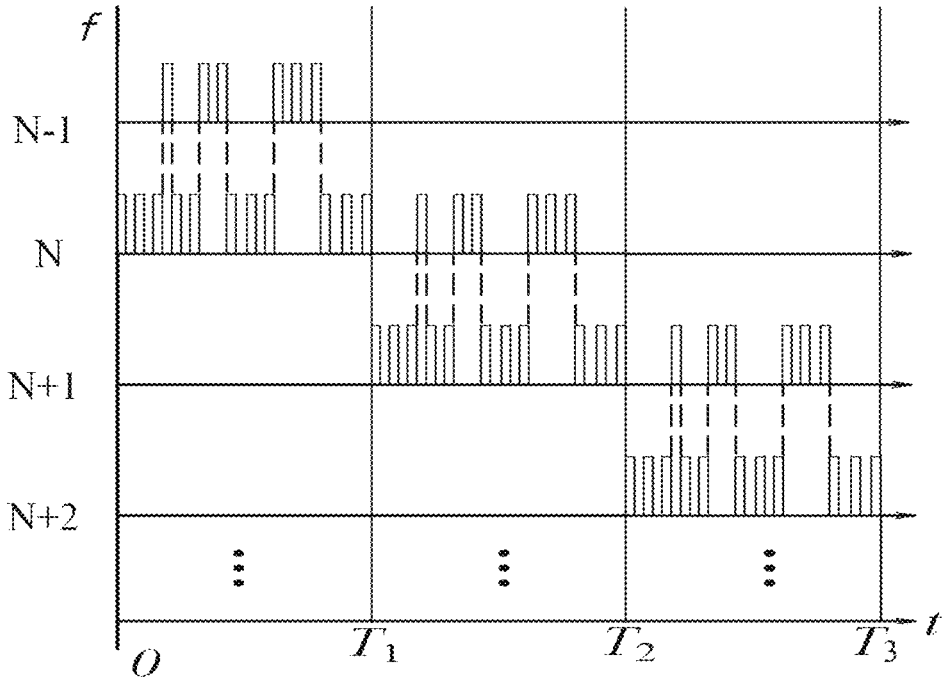
FIG. 4 is a schematic timing diagram of still another embodiment of a driving method of the present disclosure.

FIG. 4 is a schematic timing diagram of still another embodiment of a driving method of the present disclosure;

As shown in FIG. 4, in this embodiment, the applying period of the first driving signal within each driving cycle T1/T2/T3 includes three periods separated by intervals of different time lengths, the three periods correspond to the second period of the present disclosure. In this embodiment, the time lengths of the respective second periods within the same driving cycle may be different from each other. In addition, the interval between the second periods may also be proportional to the time length of the second period within the same driving cycle, for example, during the driving cycle T1 in FIG. 4, among the three second periods during which the driving signal is applied to the electrode N−1, the interval between the second periods of a shorter time length is smaller than the interval between the second periods of a longer time length.

Besides the embodiments shown in FIGS. 3 and 4, in some embodiments of the present disclosure, the applying period of the first driving signal within each driving cycle T1/T2/T3 may further include three or more second periods of the same time length but separated from each other by different intervals.

Figure 5:
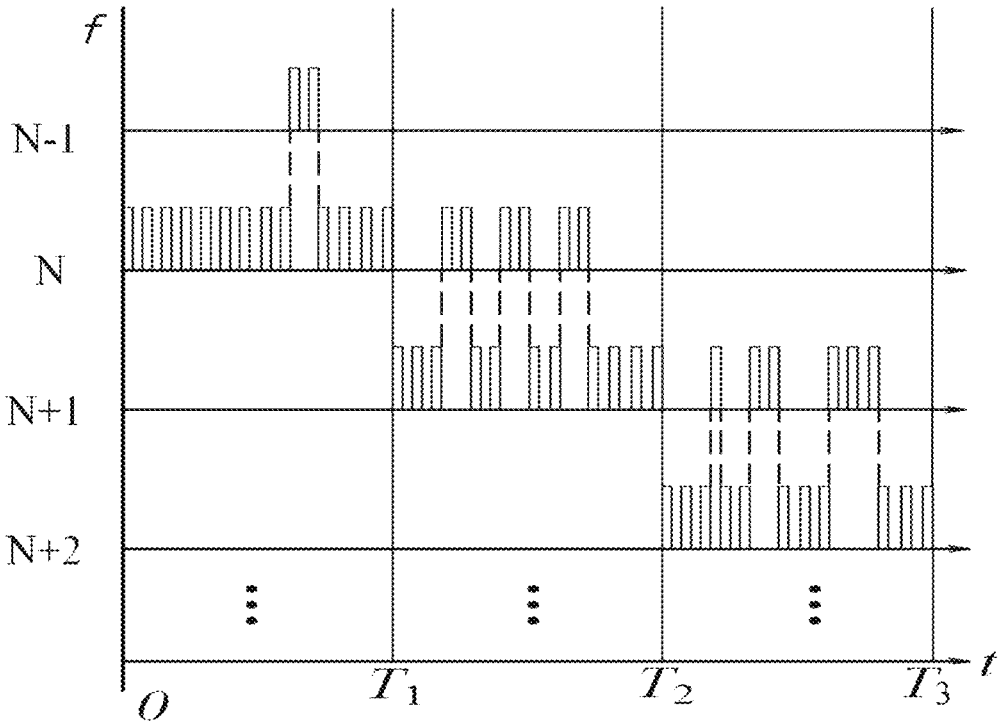
FIG. 5 is a schematic timing diagram of one embodiment of a driving method of the present disclosure.

FIG. 5 is a schematic timing diagram of one embodiment of a driving method of the present disclosure.

As shown in FIG. 5, the manners of setting the second period in which the first driving signal is applied within the driving cycle T1, T2, T3 in this embodiment may be different from each other. For example, the setting manner of the embodiment shown in FIG. 2 may be adopted within the driving cycle T1, the setting manner of the embodiment shown in FIG. 3 may be adopted within the driving cycle T2, and the setting manner of the embodiment shown in FIG. 4 may be adopted within the driving cycle T3.

The manner of setting the second period in which the first driving signal is applied within each driving cycle in the present disclosure is not limited to the setting manner shown in FIG. 5, for example, some driving cycles among all of the driving cycles may have the same setting manner.

Figure 6:
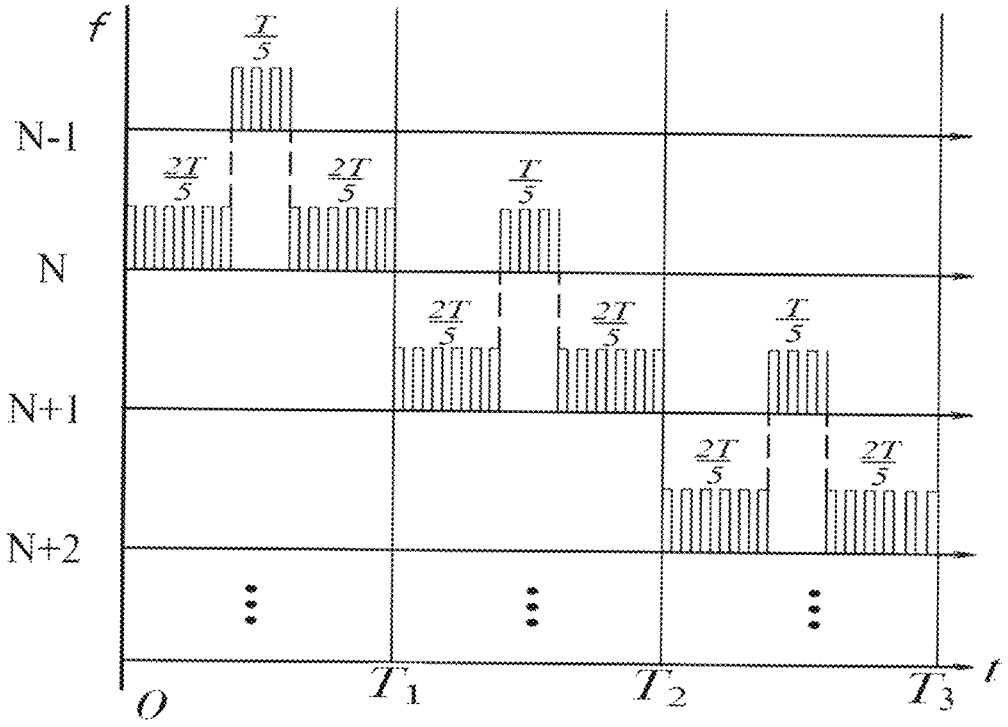
FIG. 6 is a schematic timing diagram of another embodiment of a driving method of the present disclosure.

FIG. 6 is a schematic timing diagram of another embodiment of a driving method of the present disclosure;

As shown in FIG. 6, in the embodiment of the present disclosure, within each driving cycle T1/T2/T3, a period of applying the first driving signal to the first electrode is set in the middle portion of the driving cycle, for example, within the driving cycle T1 of a time length T1, the period from 2T/5 to 3T/5. The embodiment of the present disclosure has better effect on controllability over the droplet contact angle.

The period of applying the first driving signal to the first electrode in the present disclosure is not limited to the value shown in FIG. 6. For example, the period of applying the first driving signal to the first electrode may be a period from 9T/20 to 11T/20 within the driving cycle T1.

Furthermore, the applying period of the first driving signal and an applying period of the second driving signal are not overlapped as shown in FIG. 1B to FIG. 6. That means there is only one driving signal at a time point and the driving signal is applying to the first electrode or the second electrode.

In addition, when the applying period of applying the first driving signal to the first electrode within the driving cycle T1 includes a plurality of periods, for example, including two periods, the two periods may be, for example, a period from 1T/5 to 2T/5 and a period from 3T/5 to 4T/5 within the driving cycle T1, respectively.

In the embodiment of the present disclosure, in one driving cycle T1, T2 or T3, a ratio between a total time length of the applying period of the first driving signal and a time length of the driving cycle may be in a range of 0.1 to 0.4.

In some embodiments of the present disclosure, respective parameters of the first driving signal may be adjusted in real time.

For example, the contact angle of the droplet may be detected in real time at the beginning of a certain applying period of the first driving signal, and the frequency of the first driving signal in the applying period may be adjusted according to the detected contact angle, the frequency may be, for example, set such that the smaller a detected contact angle is, the lower the frequency is. In this embodiment, the frequency of the first driving signal is adjusted according to the magnitude of the contact angle detected in real time, and control precision for the droplet can be improved.

For example, also, the duty ratio of the first driving signal in the applying period may be set according to the contact angle of the droplet detected at the beginning of the applying period of the first driving signal such that the smaller a detected contact angle is, the smaller the duty ratio is. This embodiment can also improve control precision for the droplet.

For example, also, the time length of the applying period of the first driving signal may be set according to the contact angle of the droplet detected at the beginning of the applying period of the first driving signal such that the smaller a detected contact angle is, the longer the time length is. This embodiment can also improve control precision for the droplet.

In addition, it is also possible to detect the contact angle of the droplet in real time at the end of a certain applying period of the first driving signal, and set a time length of the interval between the applying period of the first driving signal and the next applying period of the first driving signal according to a detected magnitude of the contact angle, for example, setting a time length of the interval between this applying period and the next applying period such that the smaller a detected contact angle is, the shorter the time length is. This embodiment can also improve control precision for the droplet.

In respective embodiments of the present disclosure, the fundamental frequency of the first driving signal and/or the second driving signal and the time length of the applying period can be determined according to thickness of a dielectric layer of the digital microfluidic chip. For example, the first driving signal and/or the second driving signal may be set such that the thicker the dielectric layer is, the lower the set frequency is or the longer the applying period is. Here, after the applying period of the driving signal is lengthened, the driving period may also need to be appropriately increased. The embodiment of the present disclosure is capable of adapting to characteristics of different digital microfluidic chips, effectively controlling the contact angle of the droplet.

Figure 7:
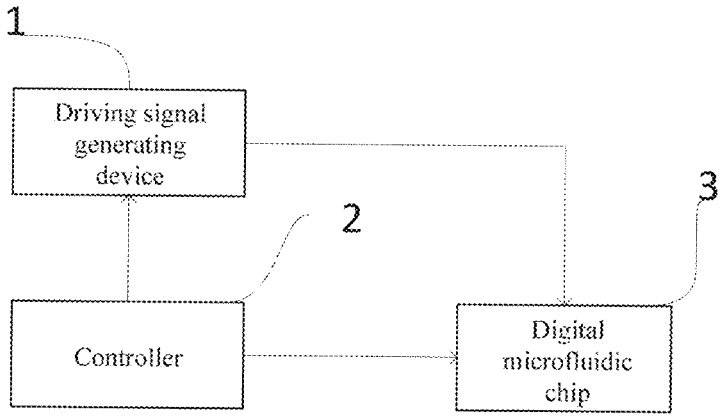
FIG. 7 is a schematic block diagram of a driving system according to some embodiments of the present disclosure.

FIG. 7 is a schematic block diagram of a driving system according to some embodiments of the present disclosure.

The driving system of the embodiment of the present disclosure is applied to the aforementioned digital microfluidic chip, and the digital microfluidic chip includes an electrode array composed of a plurality of rows and columns of electrodes, and the driving system of the embodiment of the present disclosure is used for driving the droplet between each pair of adjacent electrodes, this pair of adjacent electrodes corresponds to the first electrode and the second electrode in the present disclosure.

As shown in FIG. 7, the driving system of the embodiment of the present disclosure comprises a driving signal generating device 1 and a controller 2 for performing driving control on the digital microfluidic chip 3.

The driving signal generating device 1 may be configured to generate a first driving signal for the first electrode and a second driving signal for the second electrode. The driving signal generating device 1 may be, for example, a square wave generator, a sawtooth wave generator, or the like.

The controller 2 may be configured to control applying of a first driving signal to the first electrode and a second driving signal to the second electrode within a driving cycle of the second electrode.

Referring to the timing diagram of the embodiment shown in FIG. 1B, the controller 2 may be configured to mutually stagger an applying period of the first driving signal and an applying period of the second driving signal, and the controller 2 may be configured to enable a total time length of the applying period of the first driving signal to be less than a total time length of the applying period of the second driving signal within the driving cycle.

The controller 2 can control according to a preset period when controlling the applying period of the first driving signal.

Figure 8:
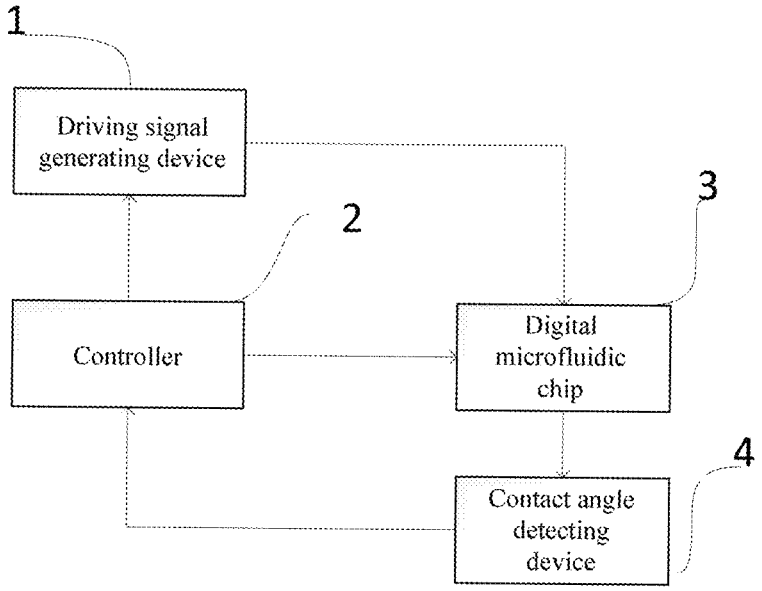
FIG. 8 is a schematic block diagram of a driving system according to another embodiment of the present disclosure.

FIG. 8 is a schematic block diagram of a driving system according to another embodiment of the present disclosure.

As shown in FIG. 8, the driving system of the embodiment of the present disclosure may further comprise a contact angle detecting device 4 that may be configured to detect a contact angle of the droplet, and the controller 2 may be configured to control or adjust respective parameters of the first driving signal according to the contact angle of the droplet as detected in real time.

For example, the controller 2 may be configured to, at the beginning of one applying period of the first driving signal, determine a time length of the applying period of the first driving signal, a duty ratio and/or a frequency of the first driving signal in this applying period according to a contact angle detected by the contact angle detecting device 4 in real time.

In addition, the controller 2 may be further configured to, at the end of the applying period of the first driving signal, determine a time length of the interval between the applying period of the first driving signal and a next applying period of the first driving signal according to a contact angle detected by the contact angle detecting device 4 in real time.

Regarding the specific control manner for the first driving signal by the controller 2, reference may be made to the description provided in conjunction with FIGS. 1-6, and detailed description is omitted here.

Figure 9:
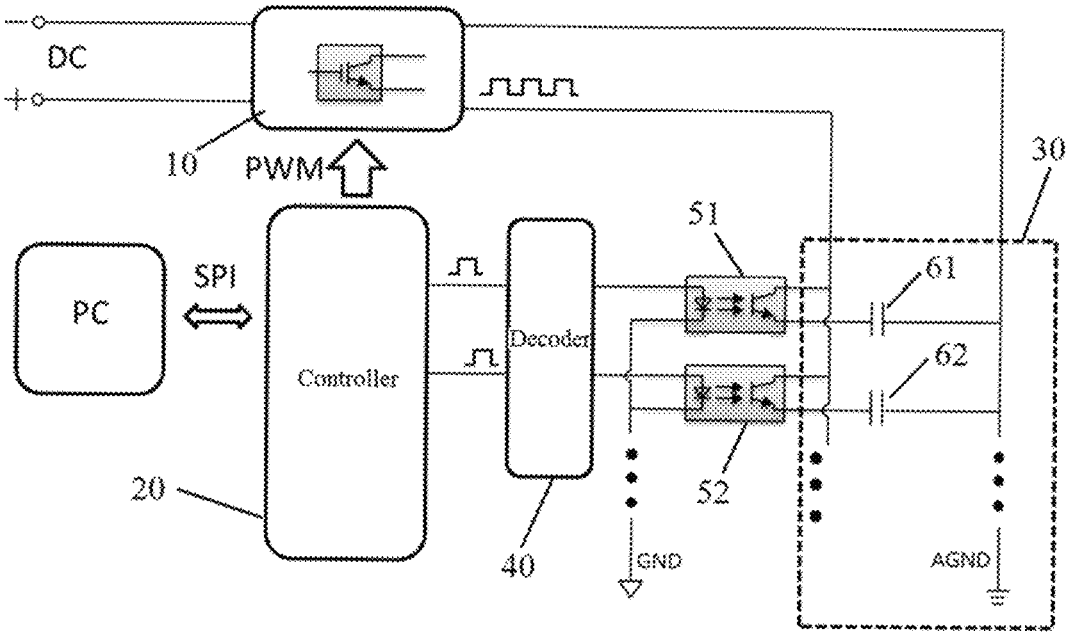
FIG. 9 is a schematic circuit diagram of a driving system according to some embodiments of the present disclosure.

FIG. 9 is a schematic circuit diagram of a driving system according to some embodiments of the present disclosure.

As shown in FIG. 9, the driving system of the embodiment of the present disclosure comprises a driving signal generating device 10, a controller 20, a decoder 40, and first and second optocouplers 51 and 52. The first and second optocouplers 51 and 52 correspond to the first and second switching devices of the present disclosure. FIG. 9 also shows the digital microfluidic chip 30 and two electrodes 61 and 62 among the plurality of electrodes disposed therein.

The first optocoupler switch 51 is connected in a loop between the first electrode 61 and the driving signal generating device 10, and the second optocoupler switch 52 is connected in a loop between the second electrode 62 and the driving signal generating device 10. The controller 20 may be configured to turn on the first optocoupler switch 51 and turn off the second optocoupler switch 52 during the applying period of the first driving signal, and to turn off the first optocoupler switch 51 and turn on the second optocoupler switch 52 during the applying period of the second driving signal.

In order to control on/off of the respective optocoupler switches, the decoder 40 may be disposed between the controller 20 and the optocoupler switch, and the controller 20 transmits, to the decoder 40, a control signal corresponding to the electrode to which the driving signal needs to be applied, the decoder 40 accurately transmits the control signal to the optocoupler switch corresponding to the electrode.

In the embodiment of the present disclosure, the first switching device and the second switching device are implemented by using the optocoupler switch, but the present disclosure is not limited thereto, for example, the first switching device and the second switching device may also be implemented by using other forms of semiconductor switch, for example, a field effect transistor is directly used to implement the switching device.

In the embodiment of the present disclosure, the applying period of each driving signal can be controlled by setting a timer. Taking the embodiment shown in FIG. 6 as an example, a first timer may be set for timing the driving cycle T1, T2 or T3; a second timer is set for timing the applying period of the second driving signal; and a third timer is set for timing the applying period of the first driving signal.

Figure 10:
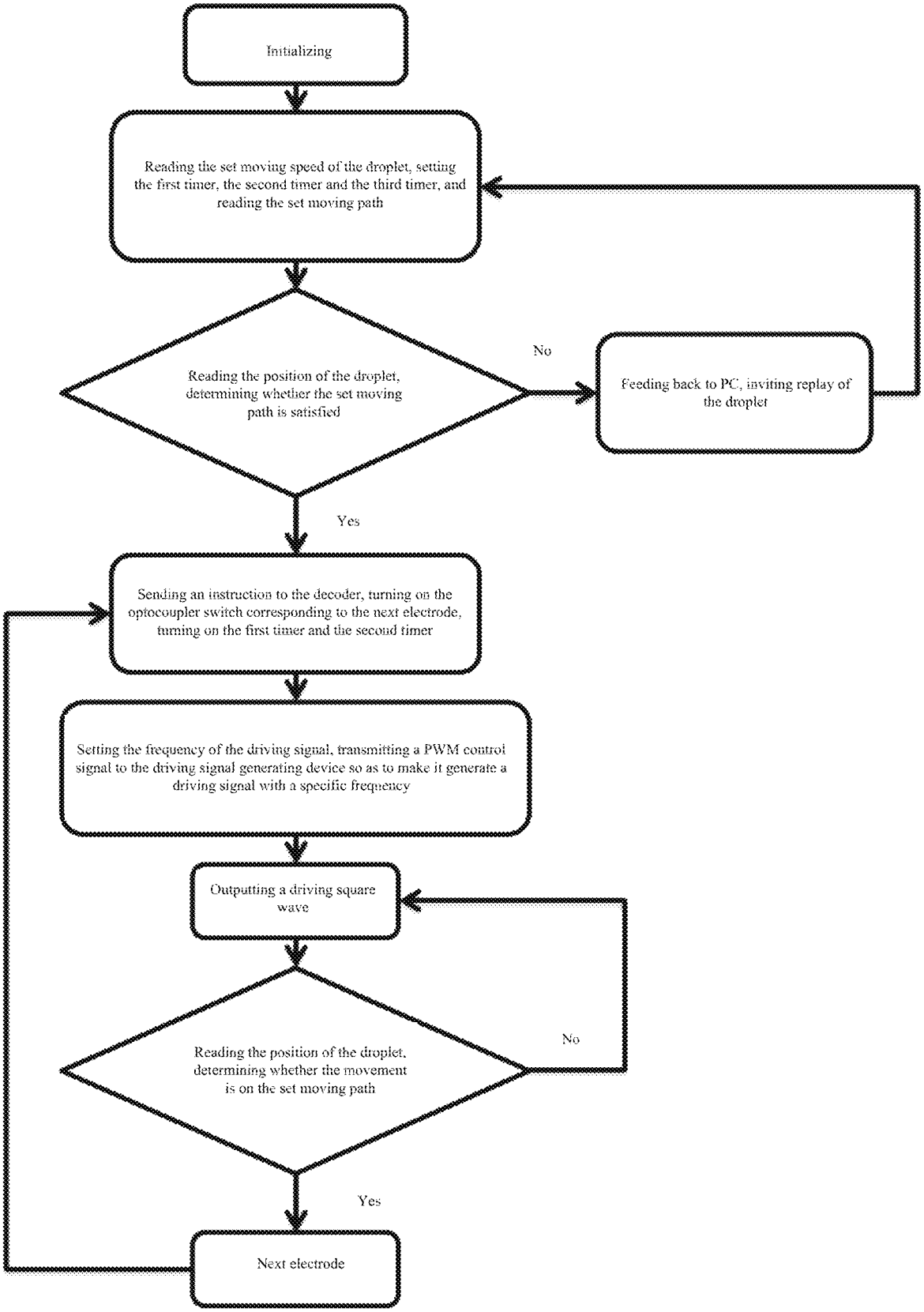
FIG. 10, FIG. 11A and FIG. 11B are schematic flowcharts showing the working process of the driving system according to some embodiments of the present disclosure.
Figure 11A:
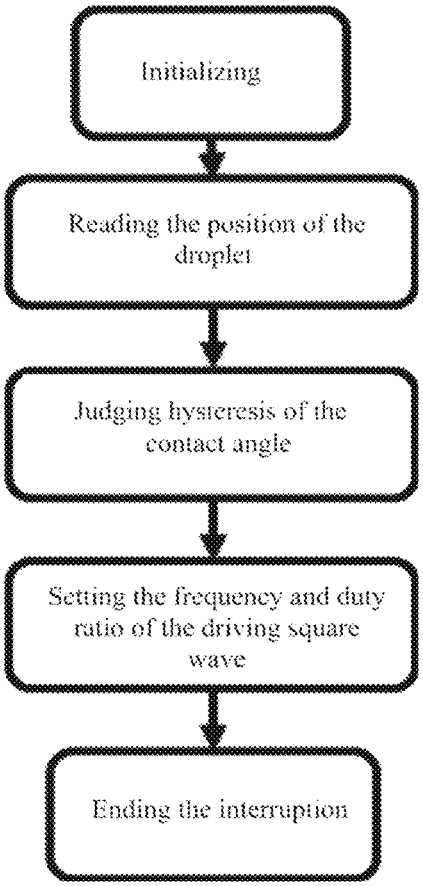
Figure 11B:
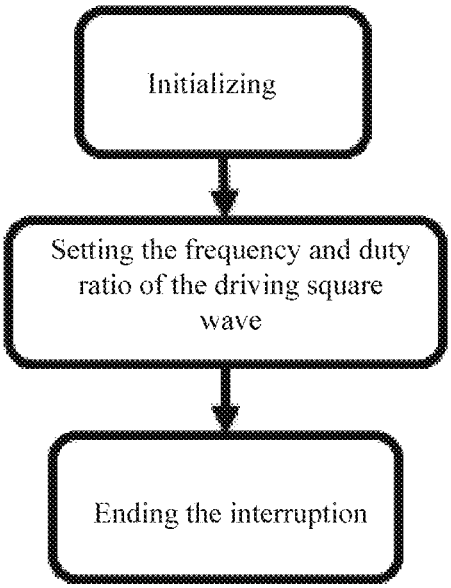

FIG. 10, FIG. 11A and FIG. 11B are schematic flowcharts showing the working process of the driving system according to some embodiments of the present disclosure.

First, as shown in FIG. 10, the controller 20 is initialized by, for example, communicating with the controller 20 via a computer (PC), data of moving speed and moving path of the droplet are read from the PC side, and the moving speed and the moving path of the droplet are set. The first timer is set according to the set moving speed of the droplet, used for setting a driving cycle (such as T1/T2/T3) for applying a driving voltage to one electrode, and the second timer and the third timer are set.

The position of the droplet is read to determine whether the set moving path is satisfied, if not satisfied, it is fed back to the PC end to invite replay of the droplet. If the set moving path is satisfied, the controller 20 sends an instruction to the decoder 40 to turn on the optocoupler switch corresponding to the next electrode of the electrode where the droplet resides, the first timer and the second timer are simultaneously turned on, a PWM control signal is transmitted to the driving signal generating device 10 so as to make it generate a driving signal with a specific frequency, for example, a driving square wave.

When the second timer runs out (i.e., when one applying period of applying the second driving signal to the second electrode ends), interruption of the second timer is entered, as shown in FIG. 11A, the droplet position is read at this timing interruption, detection is performed and hysteresis of the droplet contact angle is judged, the driving signal frequency (e.g., the driving square wave frequency) is set according to the tailing situation, and the duty ratio of the driving signal may also be set, to end the interruption. Thereafter, the third timer is turned on, the first driving signal is outputted to the first electrode according to the frequency of the driving signal set during interruption of the second timer, and it waits for runout of the third timer. When the third timer runs out (i.e., when one applying period of applying the first driving signal to the first electrode ends), interruption of the third timer is entered, as shown in FIG. 11B, the frequency and duty cycle of the second driving signal (e.g., the driving square wave frequency) for the second electrode may be reset. After the end of the interruption, the driving square wave whose driving frequency is reset during interruption of the third timer is outputted to the second electrode, and then it waits for the first timer to run out. When the first timer runs out (i.e., one driving cycle ends), the first timer interruption is entered, the droplet position is read, and it is determined whether the droplet moves on the set moving path, if the movement is on the set moving path, then the above steps are repeated for the next electrode, and if the droplet position has a deviation, the droplet is pulled back to the set moving path according to the above-described driving method.

The driving solution of the embodiments of the present disclosure can accurately control the contact angle during traveling of the droplet in the digital microfluidic chip, effectively make improvement with respect to the existing contact angle hysteresis, and increase the moving speed of the droplet.

The embodiments of the present disclosure have been described above, it is understood that the above are not all embodiments of the present disclosure, based on those disclosed in the present disclosure, those skilled in the art can also obtain the embodiments of other modifications and variations without departing from the concept of the present disclosure, these modifications and variations are intended to be included within the protection scope of the present disclosure.

This application claims the priority of Chinese Patent Application No. 201710910461.6, filed on Sep. 29, 2017, which is hereby incorporated by reference in its entirety as a part of this application.

What is claimed is:

1. A driving method for a digital microfluidic chip, the digital microfluidic chip including a first electrode and a second electrode that are adjacent, the driving method comprising:

applying a first driving signal to the first electrode and a second driving signal to the second electrode, controlling an applying period of the first driving signal and an applying period of the second driving signal are mutually staggered, wherein a total time length of the applying period of the first driving signal is less than a total time length of the applying period of the second driving signal, wherein the driving method further comprises:

detecting a contact angle of a droplet; and determining, at the beginning of the applying period of the first driving signal, a characteristic of the first driving signal according to the detected contact angle, wherein the characteristic includes at least one of a time length, a duty ratio, and a frequency in the applying period.

2. The driving method according to claim 1, wherein a frequency of the first driving signal is less than or equal to a frequency of the second driving signal.

3. The driving method according to claim 1, wherein the applying period of the first driving signal includes one continuous first period or a plurality of second periods separated from each other by an interval.

4. The driving method according to claim 3, wherein a time length of the second period is proportional to a time length of the interval.

5. The driving method according to claim 1, wherein the driving method further comprises:

setting the frequency of the first driving signal in the applying period, wherein the frequency is set to decrease as the detected contact angle decreases.

6. The driving method according to claim 1, wherein the driving method further comprises:

setting the duty ratio of the first driving signal in the applying period, wherein the duty ratio is set to decrease as the detected contact angle decreases.

7. The driving method according to claim 1, wherein the driving method further comprises:

setting the time length of the applying period of the first driving signal, wherein the time length of the applying period of the first driving signal is set to increase as the detected contact angle decreases.

8. The driving method according to claim 1, wherein the driving method further comprises:

at the end of the applying period of the first driving signal, detecting a contact angle of the droplet in real time, and setting a time length of an interval between the applying period of the first driving signal and a next applying period of the first driving signal, wherein the time length of the interval between the applying period of the first driving signal and the next applying period of the first driving signal is set to decrease as the detected contact angle decreases.

9. The driving method according to claim 1, wherein the first driving signal and/or the second driving signal are set according to thickness of a dielectric layer of the digital microfluidic chip, wherein the frequency is set to decrease as the thickness decreases, and a time length of the applying period is set to increase as the thickness decreases.

10. A driving system for driving a digital microfluidic chip according to a driving method of claim 1, wherein the system comprising:

a driving signal generating device configured to generate a first driving signal for the first electrode and a second driving signal for the second electrode; and a controller configured to control applying of the first driving signal to the first electrode and the second driving signal to the second electrode, the controller being configured to mutually stagger an applying period of the first driving signal and an applying period of the second driving signal, and the controller being configured to enable a total time length of the applying period of the first driving signal to be less than a total time length of the applying period of the second driving signal.

11. The driving system according to claim 10, further comprising:

a first switching device connected in a loop between the first electrode and the driving signal generating device; and a second switching device connected in a loop between the second electrode and the driving signal generating device, wherein the controller is configured to turn on the first switching device and turn off the second switching device during the applying period of the first driving signal, and configured to turn off the first switching device and turn on the second switching device during the applying period of the second driving signal.

12. The driving system according to claim 10, wherein the controller is configured to, at the end of the applying period of the first driving signal, determine a time length of an interval between the applying period of the first driving signal and a next applying period of the first driving signal according to a contact angle detected by the contact angle detecting device in real time.

13. The driving system according to claim 10, further comprising:

a second timer, configured to time the applying period of the second driving signal; and a third timer, configured to time the applying period of the first driving signal.

14. A driving method for a digital microfluidic chip, the digital microfluidic chip including a first electrode and a second electrode for controlling a movement of a droplet, the driving method comprising:

applying a first driving signal to the first electrode during an applying period of a first driving signal;

applying a second driving signal to the second electrode during an applying period of a second driving signal;

detecting a contact angle of the droplet; and determining a characteristic of the first driving signal and second driving signal according to the contact angle, wherein the characteristic includes at least one of a time length, a duty ratio, and a frequency, wherein the first driving signal and the second driving signal are determined based on the contact angle of the droplet, wherein a total time length of the applying period of the first driving signal is less than a total time length of the applying period of the second driving signal.

15. A driving system for a digital microfluidic chip, the digital microfluidic chip including a first electrode and a second electrode for controlling a movement of a droplet, wherein the system comprises:

a controller configured to applying a first driving signal to the first electrode during an applying period of the first driving signal and applying a second driving signal to the second electrode during an applying period of the second driving signal;

wherein the first driving signal and second driving signal are determined based on a contact angle of the droplet, wherein a total time length of the applying period of the first driving signal is less than a total time length of the applying period of the second driving signal, wherein the driving system further comprises:

a contact angle detecting device configured to detect the contact angle of the droplet, and the controller is configured to determine a characteristic of the first driving signal and second driving signal according to the contact angle detected by the contact angle detecting device in real time, wherein the characteristic includes at least one of a time length, a duty ratio, and a frequency.

* * * * *